US007552777B2

(12) United States Patent
Murray et al.

(10) Patent No.: US 7,552,777 B2
(45) Date of Patent: Jun. 30, 2009

(54) SELF-ENERGIZED DOWNHOLE TOOL

(75) Inventors: Douglas J. Murray, Humble, TX (US); Vel Berzin, Houston, TX (US); Edward T. Wood, Kingwood, TX (US); Gregory C. Badke, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 145 days.

(21) Appl. No.: 11/320,113

(22) Filed: Dec. 28, 2005

(65) Prior Publication Data

US 2007/0144731 A1 Jun. 28, 2007

(51) Int. Cl.
*E21B 23/00* (2006.01)

(52) U.S. Cl. ..... 166/381; 166/376

(58) Field of Classification Search ..... 166/381, 166/376, 377, 242.7, 317, 120, 242.6; 251/11; 236/101 R–101 E
See application file for complete search history.

(56) References Cited

U.S. PATENT DOCUMENTS

| | | | | |
|---|---|---|---|---|
| 3,420,363 | A | 1/1969 | Blickensderfer | |
| 3,918,523 | A | 11/1975 | Stuber | |
| 4,137,970 | A | 2/1979 | Laflin et al. | |
| 4,612,985 | A | 9/1986 | Rubbo et al. | |
| 4,640,354 | A * | 2/1987 | Boisson | 166/250.01 |
| 4,862,967 | A | 9/1989 | Harris | |
| 4,919,989 | A | 4/1990 | Colangelo | |
| 4,936,386 | A | 6/1990 | Colangelo | |
| 4,990,545 | A | 2/1991 | Hourai et al. | |
| 5,048,605 | A | 9/1991 | Toon et al. | |
| 5,049,591 | A | 9/1991 | Hayashi et al. | |
| 5,145,935 | A | 9/1992 | Hayashi | |
| 5,195,583 | A | 3/1993 | Toon et al. | |
| 5,199,497 | A * | 4/1993 | Ross | 166/381 |
| 5,558,153 | A * | 9/1996 | Holcombe et al. | 166/373 |
| 5,687,795 | A * | 11/1997 | Patel et al. | 166/387 |
| 5,906,238 | A | 5/1999 | Carmody et al. | |

(Continued)

FOREIGN PATENT DOCUMENTS

| | | |
|---|---|---|
| DE | 3700717 | 7/1988 |

(Continued)

OTHER PUBLICATIONS http://www.alchemycastings.com/lead-products/fusible.htm.

(Continued)

*Primary Examiner*—Jennifer H Gay
*Assistant Examiner*—Cathleen R Hutchins
(74) *Attorney, Agent, or Firm*—Steve Rosenblatt

(57) ABSTRACT

Setting mechanisms for downhole tools are described that take advantage of hydrostatic pressure in the wellbore which is harnessed to set a tool after exposure to well fluids for a given time or temperature defeats a lock and allows hydrostatic forces to trigger the setting of the tool. Alternatively, some other biasing source is released to set the downhole tool after exposure to well fluids for a time or a temperature and time defeats a lock and allows the biasing source to set the tool. While applications to packers are preferred, other downhole tools can be set in his manner removing the need for an inner string, dropping a ball on a seat or pressurizing the wellbore to achieve the setting of the downhole tool.

20 Claims, 3 Drawing Sheets

U.S. PATENT DOCUMENTS

| | | | | |
|---|---|---|---|---|
| 6,032,733 | A * | 3/2000 | Ludwig et al. | 166/60 |
| 6,073,692 | A | 6/2000 | Wood et al. | |
| 6,354,379 | B2 * | 3/2002 | Miszewski et al. | 166/377 |
| 6,425,443 | B1 * | 7/2002 | Hill et al. | 166/377 |
| 6,583,194 | B2 | 6/2003 | Sendijarevic | |
| 6,817,441 | B2 | 11/2004 | Murakami et al. | |
| 6,834,725 | B2 | 12/2004 | Whanger et al. | |
| 6,848,505 | B2 | 2/2005 | Richard et al. | |
| 6,854,522 | B2 | 2/2005 | Brezinski et al. | |
| 6,976,542 | B2 | 12/2005 | Henriksen et al. | |
| 2001/0001420 | A1 * | 5/2001 | Miszewski et al. | 166/376 |
| 2003/0116315 | A1 * | 6/2003 | Wellington et al. | 166/256 |
| 2004/0020662 | A1 | 2/2004 | Freyer | |
| 2004/0055760 | A1 | 3/2004 | Nguyen | |
| 2004/0118572 | A1 | 6/2004 | Whanger et al. | |
| 2004/0194971 | A1 | 10/2004 | Thomson | |
| 2004/0216887 | A1 * | 11/2004 | Bertelsen | 166/377 |
| 2004/0261990 | A1 | 12/2004 | Bosma et al. | |
| 2005/0067170 | A1 | 3/2005 | Richard | |
| 2005/0092363 | A1 | 5/2005 | Richard et al. | |
| 2005/0110217 | A1 | 5/2005 | Wood et al. | |
| 2006/0042798 | A1 * | 3/2006 | Badalamenti et al. | 166/285 |
| 2006/0175065 | A1 | 8/2006 | Ross | |
| 2007/0012434 | A1 | 1/2007 | Ribberberg | |
| 2007/0044962 | A1 | 3/2007 | Tibbles | |
| 2007/0125532 | A1 * | 6/2007 | Murray et al. | 166/179 |
| 2007/0137865 | A1 * | 6/2007 | Farrar et al. | 166/381 |
| 2007/0246213 | A1 | 10/2007 | Hailey, Jr. | |
| 2007/0246225 | A1 | 10/2007 | Hailey, Jr. et al. | |

FOREIGN PATENT DOCUMENTS

| | | |
|---|---|---|
| GB | 851365 | 10/1960 |
| GB | 2328463 | 2/1999 |
| GB | 2411918 | 9/2005 |
| GB | 2416796 | 2/2006 |
| GB | 2421527 A | 6/2006 |
| GB | 2421746 | 7/2006 |
| JP | 04-363499 | 12/1992 |
| JP | 09-151686 | 6/1997 |
| JP | 2000-064764 | 2/2000 |
| WO | 9958809 | 11/1999 |
| WO | WO 2004/018836 A1 | 3/2004 |
| WO | 2005035937 | 4/2005 |
| WO | 2006015277 | 2/2006 |
| WO | 2007124374 | 1/2007 |

OTHER PUBLICATIONS http://www.solders.com/low_melt_alloys.htm.

* cited by examiner

SELF-ENERGIZED DOWNHOLE TOOL

FIELD OF THE INVENTION

The field of this invention relates to setting devices for downhole tools that automatically actuate them after certain conditions are met and more particularly focuses on time or temperature or combinations of those conditions.

BACKGROUND OF THE INVENTION

Devices to actuate downhole tools such as external casing packers, for example normally require an inner string to shift a sliding sleeve or a straddle tool to bridge over an inflate port to set the downhole tool. Other techniques involve dropping a ball on a seat or pressurizing the wellbore. Each of these techniques for setting a downhole tool has limitations in certain well conditions and associated costs to implement.

What is needed and made possible by the present invention is a technique to set a downhole tool in an alternative way based on conditions that exist in the wellbore. In a specific embodiment exposure to well fluids at a predetermined temperature for a predetermined time allows the tool to be set. These and other advantages of the present invention will be more apparent to those skilled in the art from a review of the description of the preferred embodiment and associated drawings and the claims that all appear below.

SUMMARY OF THE INVENTION

Setting mechanisms for downhole tools are described that take advantage of hydrostatic pressure in the wellbore which is harnessed to set a tool after exposure to well fluids for a given time or temperature defeats a lock and allows hydrostatic forces to trigger the setting of the tool. Alternatively, some other biasing source is released to set the downhole tool after exposure to well fluids for a time or a temperature and time defeats a lock and allows the biasing source to set the tool. While applications to packers are preferred, other downhole tools can be set in his manner removing the need for an inner string, dropping a ball on a seat or pressurizing the wellbore to achieve the setting of the downhole tool.

DETAILED DESCRIPTION OF THE PREFERRED EMBODIMENT

Figure 1:
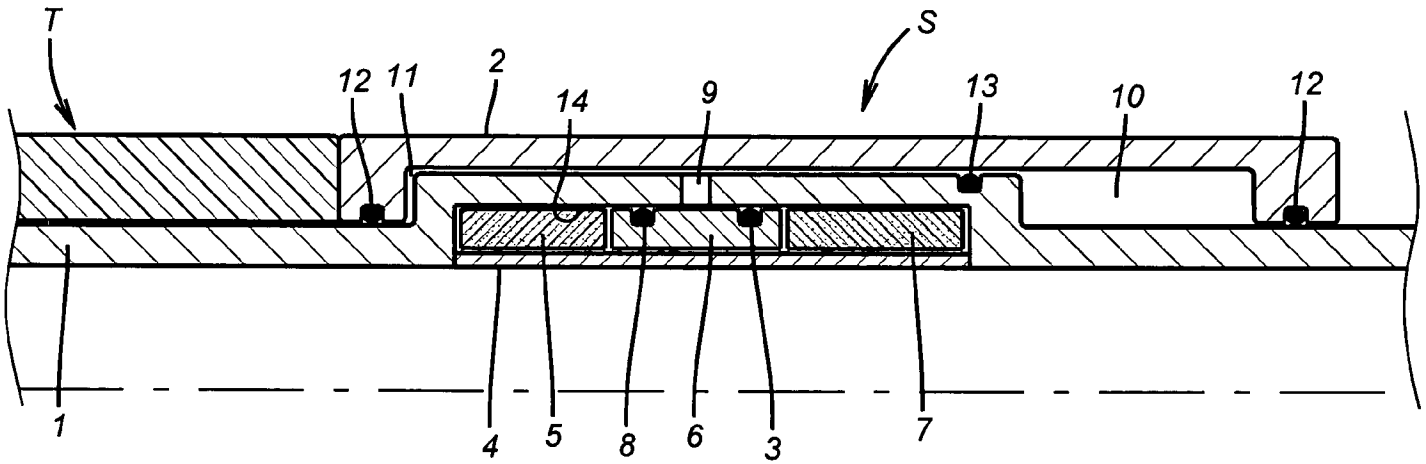
FIG. 1 is a section view in the run in position of a first embodiment that allows hydrostatic or applied well pressure to set a tool after a restraining member is defeated.

The mandrel 1 of the depicted setting tool S extends to a schematically illustrated downhole tool T that is preferably a packer but can be another type of tool known in the art.

Mandrel 1 has a port 9 that is initially covered by a sleeve 6 that has seals 3 and 8 straddling the port 9 to keep it closed. Sleeve 6 is disposed in an internal recess 14 with a restrainer 5 on one side and an energy source 7 on the other side. Energy source 7 can't move the sleeve 6 as long as restrainer 5 is serviceable. A protective sleeve 4 overlays sleeve 6, energy source 7 and restrainer 5 to protect hem from tools or other objects moved through mandrel 1. Sleeve 4 allows well fluids in the mandrel 1 to get to restrainer 5 and energy source 7 as will be described below.

Figure 2:
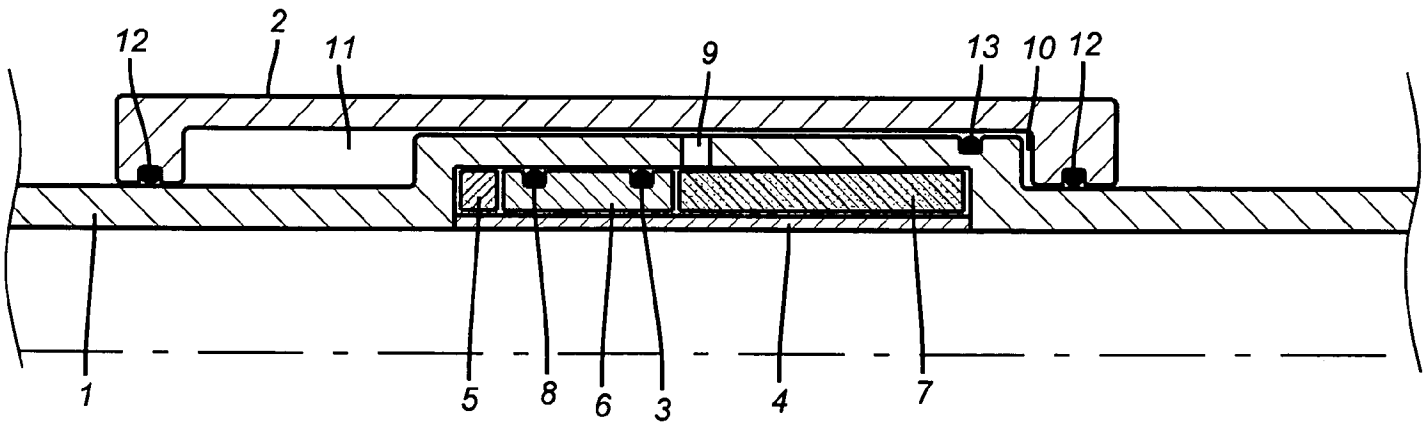
FIG. 2 is the view of F*igure* 1 where the restraining member is sufficiently removed to allow the tool to be set.

Piston 2 covers port 9 and is mounted to mandrel 1 with seals 12 located at or near opposed ends. Seal 13 seals between the mandrel 1 and the piston 2 in a way to define atmospheric chamber 10 near the end opposite from tool T. The energy source 7 can take a variety of forms. It can be a spring, a pressurized chamber, a material that is resilient and installed in a compressed condition or it can be made of a material that grows on contact with well fluids or can in other ways be triggered to assume another shape such as a shape memory material that reverts to a larger size in response to a triggering signal. In whatever form it takes, it needs to be strong enough to shove sleeve 6 over so that seals 3 and 8 no longer straddle port 9 and pressure in mandrel 1 can reach atmospheric chamber 10 to pressurize it and move piston 2 against the tool T. However, none of that can or should happen until the restrainer 5 stops holding sleeve 6 against a force coming from energy source 7. Restrainer 5 can take various forms. It can be a material that reacts or otherwise interacts with well fluids to get smaller, as shown in FIG. 2 so that well fluid in mandrel 1 could get past port 9 into chamber 11 and slide piston 2 to set the tool T. It can be a material sensitive to the hydrostatic pressure to fail at a given depth. It can be a material sensitive to exposure to a predetermined temperature over a predetermined time so as to allow enough of a delay period for properly positioning the tool T before piston 2 can set it. The selection of the material can be from known materials that exhibit the desired properties. The main desired effect is to allow a sufficient time delay once the tool gets close to where it will be set so that it can be properly positioned before it is automatically set. The specific design of FIGS. 1 and 2 is but one way to accomplish the automatic setting with a delay feature. Having the ability to do this takes away the need for running an inner string or dropping a ball or applying pressure from the surface to set a tool that is delivered downhole.

Figure 3:
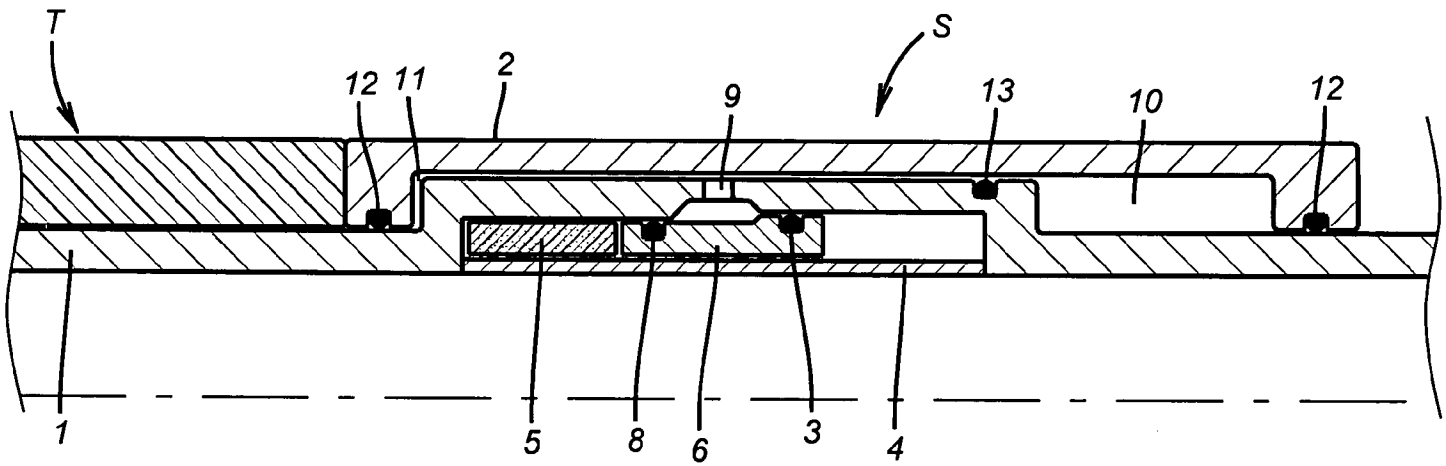
FIG. 3 is alternative embodiment to FIG. 1 shown in the run in position.
Figure 4:
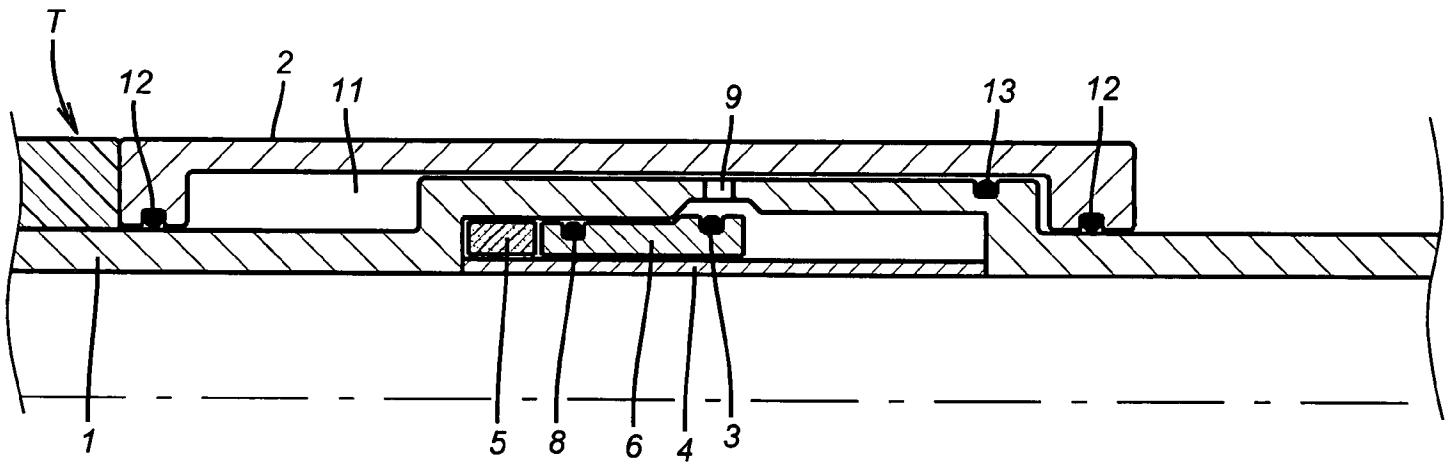
FIG. 4 is the view of FIG. 3 in the tool set position.

The setting tool S is somewhat altered in FIGS. 3 and 4. The main difference is that sleeve 6 has a larger diameter o-ring 3 at one end than o-ring 8 at the other end. As a result of these unequal diameters, the hydrostatic pressure in the mandrel 1 normally exerts a force toward tool T at all times. However, for run in the restrainer 5 is in position and prevents the unbalanced force from moving the sleeve 6. Since there is always a net unbalanced force on sleeve 6 during run in, there is no longer any need for energy source 7, as, in effect, the energy source is now the hydrostatic pressure that creates the unbalanced force on sleeve 6 due to the differing end diameters. As before with FIGS. 1 and 2 in the embodiment of FIGS. 3 and 4 nothing happens until the restrainer 5 stops being there by a variety of mechanisms. The time it takes to go away is the delay period that allows proper positioning of the tool T. In the preferred embodiment exposure to a predetermined temperature level for a predetermined time makes the restrainer fail or stop restraining and allows the unbalanced pressure on sleeve 6 to shift it to pressurize chamber 11 which allows the piston 2 to move, since chamber 10 is at atmospheric. FIG. 4 shows the shifted position of piston 2 to set the tool T. The restraint 5 can be a polymer with a glass transition temperature near the expected well temperature at the setting depth. As the temperature is reached the material softens to allow shifting of sleeve 6, opening of port 9 and the ultimate shifting of the piston 2. Alternatively the sleeve 6, restrainer 5 and energy source 7 can be replaced with a sleeve of a shape memory material that initially blocks port 9 but then resumes a former shape that allows flow through port 9, preferably through a thermal input from being run to the desired location.

Figure 5:
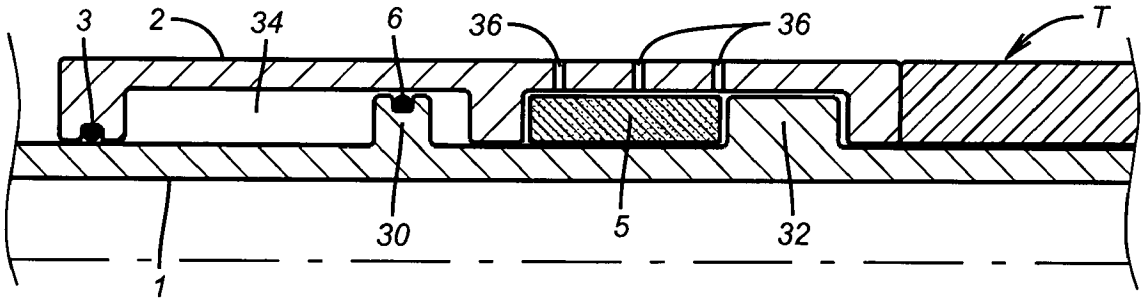
FIG. 5 is a section view in the run in position of an alternative embodiment that employs a stored force within the mechanism to be released and set the downhole tool.
Figure 6:
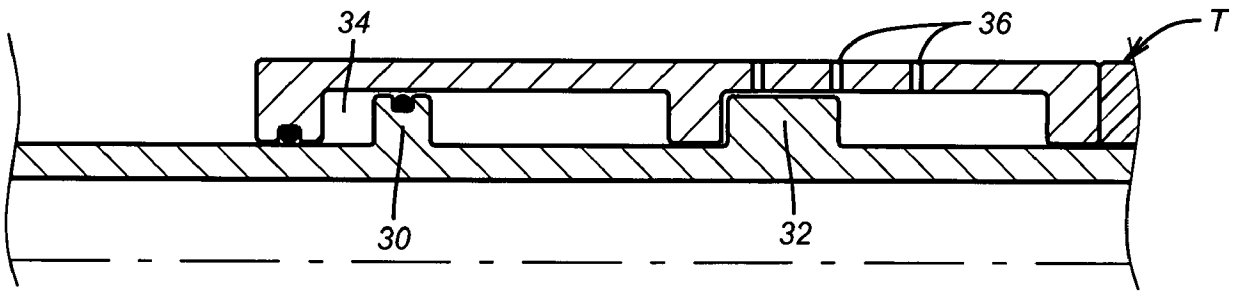
FIG. 6 is the view of FIG. 5 in the tool set position.
Figure 7:
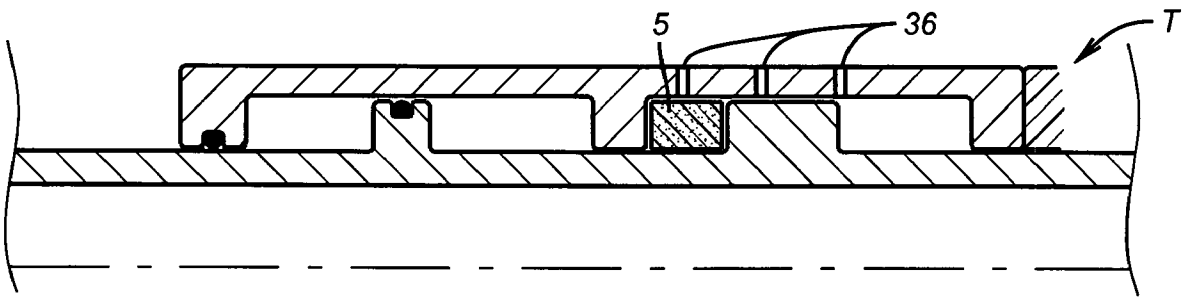
FIG. 7 is an alternative to the FIG. 5 design showing a different restraining material whose removal under well conditions, in the depicted position, sets the tool.

FIG. 5 shows another variation using the mandrel 1 and the piston 2 to actuate a tool T. Mandrel 1 has a tab 30 and another tab 32 and between them the restrainer 5 is disposed. Chamber 34 is at atmospheric and is sealed by seals 3 and 6 but piston 2 can't move in response to the hydrostatic pressure acting on it because of restrainer 5. Ports 36 allow well fluids to reach the restrainer 5 to ultimately make it get smaller or just go away so that there is no longer resistance to the hydrostatic pressure acting on piston 2 thereby allowing it to shift to the right to set the tool T. The set position is shown in FIG. 6. If a dissolving polymer is used for the restrainer 5 the remains of it will pass through the ports 36 as chunks or in solution. FIG. 7 shows an alternate embodiment to the restrainer 5 that can be a polymer with a low $T_g$ so that it simply collapses as seen by comparing FIGS. 5 and 7. Alternatively the restrainer 5 in FIGS. 5-7 can be a foam or mechanical device that collapses, preferably after a delay upon getting the tool T to a proper depth so as to allow time for proper placement before the automatic setting.

What has been presented in the present invention is a way to automatically actuate tools downhole without the need for a running string, dropping balls or pressuring the wellbore. The common features of the various embodiments are a way to deliver the tool to close to where it will be actuated without it immediately being set. Then, the delay time between the start of the sequence and the actual actuation can be used to secure a final position of tool before it is set. Preferably the delay involves exposure to well fluids coupled with time. Alternatively, there can be an overlay involving the temperature of the well fluids and the time of exposure. The layout of the components and the nature of the material that is used as the restrictor determine the parameters involved in creating the delay insofar as initiating the period and its duration. The selection of materials that are used as a restrictor can vary with the anticipated well conditions. The invention is not necessarily the use of a given material that changes properties over time, in and of itself. Rather, it is the application of such known materials in the context of an automatic setting mechanism that can actuate a wide variety of downhole tools. While a preferred use is actuation of packers, other downhole tools can as easily be actuated such as sliding sleeves, anchors, bridge plugs to name just a few examples. The ultimately unleashed stored force can be available hydrostatic pressure, a resilient material that is installed to hold a stored force, a shape memory material, a pressurized chamber, one or more springs of various types, just to name a few examples.

The above description is illustrative of the preferred embodiment and many modifications may be made by those skilled in the art without departing from the invention whose scope is to be determined from the literal and equivalent scope of the claims below:

We claim:

1. An apparatus for setting a downhole tool in existing well fluid, comprising:

a mandrel comprising an actuating component assembly relatively moveable thereto for selective actuation of the downhole tool;

a restraining member, having a longitudinal axis, said restraining member acting on said actuating component assembly, said restraining member remaining operative for delivery of the downhole tool to near the position where said actuating component assembly will then be actuated by release of compressive loading acting on said actuating component assembly, and whereupon said delivery, a delay period is triggered that terminates with the release of said actuating component assembly by said restraining member by virtue of a developed inability of the restraining member to resist said compressive force which results in a collapse along said longitudinal axis of said restraining member without shear of said restraining member, responsive to exposure of said restraining member to said existing downhole fluid, for automatic setting of the downhole tool;

said developed inability of said restraining member comprises weakening from at least one of temperature of the well fluids and duration of exposure to said existing well fluids;

said weakening comprises dissolving said restraining member.

2. An apparatus for setting a downhole tool, comprising:

a mandrel comprising an actuating component relatively moveable thereto for selective actuation of the downhole tool;

a restraining member acting on said actuating component assembly, said restraining member remaining operative for delivery of the downhole tool to near the position where said actuating component assembly will then be actuated by defeat of said restraining member, and whereupon said delivery a delay period is triggered that terminates with the release of said actuating component assembly by said restraining member for automatic setting of the downhole tool;

said restraining member begins to weaken from at least one of temperature of the well fluids and duration of exposure to well fluids;

said actuating component assembly comprises a piston movable by hydrostatic pressure in the wellbore upon said weakening of said restraining member;

said piston defines at least one sealed chamber at a pressure lower than the available hydrostatic pressure, whereupon weakening of said restraining member the volume of said chamber is reduced as said piston moves to set the downhole tool;

said piston defines a second sealed chamber with a port and a valve selectively putting said second sealed chamber in fluid communication with available hydrostatic pressure, whereupon said weakening of said restraining member said port opens to move said piston.

3. The apparatus of claim 2, wherein:

the volume of said second sealed chamber grows as said valve opens while the volume of said first chamber shrinks as a result of movement of said piston.

4. The apparatus of claim 2, wherein:

said valve comprises a sleeve covering said port, said sleeve configured for end dimensions of differing sizes to create a net unbalanced force from available hydrostatic pressure;

said restraining member preventing movement of said sleeve from said unbalanced force until said weakening.

5. The apparatus of claim 2, wherein:

said valve comprises a sleeve covering said port;

said sleeve further subjected to a stored force from an energy source operably connected thereto but incapable of shifting said sleeve until weakening of said restraining member.

6. The apparatus of claim 5, wherein:

said energy source and said restraining member are disposed at opposed ends of said sleeve.

7. The apparatus of claim 5, wherein:

said energy source comprises fluid pressure.

8. The apparatus of claim 5, wherein:

said energy source comprises at least one spring.

9. The apparatus of claim 5, wherein:

said energy source comprises an initially compressed resilient material.

10. The apparatus of claim 5, wherein:

said energy source comprises a shape memory material that grows in one dimension as said restraining member is weakening.

11. The apparatus of claim 5, wherein:

said energy source comprises foam.

12. An apparatus for setting a downhole tool in existing well fluid, comprising:

a mandrel comprising an actuating component assembly relatively moveable thereto for selective actuation of the downhole tool;

a restraining member, having a longitudinal axis, said restraining member acting on said actuating component assembly, said restraining member remaining operative for delivery of the downhole tool to near the position where said actuating component assembly will then be actuated by release of compressive loading acting on said actuating component assembly, and whereupon said delivery, a delay period is triggered that terminates with the release of said actuating component assembly by said restraining member by virtue of a developed inability of the restraining member to resist said compressive force which results in a collapse along said longitudinal axis of said restraining member without shear of said restraining member, responsive to exposure of said restraining member to said existing downhole fluid, for automatic setting of the downhole tool.

13. The apparatus of claim 12, wherein:

said developed inability of said restraining member comprises weakening from at least one of temperature of the well fluids and duration of exposure to said existing well fluids.

14. The apparatus of claim 13, wherein:

said weakening comprises structural failure of said restraining member.

15. The apparatus of claim 13, wherein:

said weakening comprises a reduction in volume of said restraining member.

16. The apparatus of claim 13, wherein:

said weakening comprises a shape memory material acting as said restraining member and reverting to a different shape.

17. The apparatus of claim 13, wherein:

said actuating component assembly comprises a piston movable by hydrostatic pressure in the wellbore upon said weakening of said restraining member.

18. The apparatus of claim 17, wherein:

said piston defines at least one sealed chamber at a pressure lower than the available hydrostatic pressure, whereupon weakening of said restraining member the volume of said chamber is reduced as said piston moves to set the downhole tool.

19. The apparatus of claim 18, wherein:

said piston defines a second chamber wherein said restraining member is disposed such that said piston cannot move with respect to said mandrel until said weakening of said restraining member.

20. The apparatus of claim 19, wherein:

said second chamber comprises an opening past said piston to allow well fluids to enter said chamber during run in.

* * * * *